US011473452B2

(12) United States Patent
Batscha et al.

(10) Patent No.: US 11,473,452 B2
(45) Date of Patent: Oct. 18, 2022

(54) AIR-COOLED CONDENSER CONFIGURATION

(71) Applicant: ORMAT TECHNOLOGIES INC.

(72) Inventors: Dany Batscha, Kiriat Ono (IL); Anton Fiterman, Moshav Shani (IL)

(73) Assignee: ORMAT TECHNOLOGIES INC., Reno, NV (US)

( * ) Notice: Subject to any disclaimer, the term of this patent is extended or adjusted under 35 U.S.C. 154(b) by 0 days.

(21) Appl. No.: 16/481,318

(22) PCT Filed: Dec. 26, 2018

(86) PCT No.: PCT/IB2018/060608

§ 371 (c)(1),
(2) Date: Jul. 26, 2019

(87) PCT Pub. No.: WO2019/130212

PCT Pub. Date: Jul. 4, 2019

(65) Prior Publication Data

US 2020/0123934 A1 Apr. 23, 2020

Related U.S. Application Data

(60) Provisional application No. 62/611,323, filed on Dec. 28, 2017.

(51) Int. Cl.
*F01K 25/08* (2006.01)
*F01K 9/00* (2006.01)
(Continued)

(52) U.S. Cl.
CPC ..... *F01K 25/08* (2013.01); *F01K 9/003* (2013.01); *F28D 1/024* (2013.01); *F28D 1/06* (2013.01)

(58) Field of Classification Search
CPC ..... F28B 1/06; F28B 1/08; F28B 2001/065; F28D 1/024; F28D 2021/0061;
(Continued)

(56) References Cited

U.S. PATENT DOCUMENTS 3,707,185 A 12/1972 Modine et al.
3,807,494 A * 4/1974 Ris ..... F28B 11/00 165/110

(Continued)

FOREIGN PATENT DOCUMENTS

GB 1483730 A * 8/1977 ..... F28B 9/06

OTHER PUBLICATIONS

International Search Report dated May 31, 2019 in PCT/IB2018/060608 filed Dec. 23, 2018.

*Primary Examiner* — Mickey H France
(74) *Attorney, Agent, or Firm* — Oblon, McClelland, Maier & Neustadt, L.L.P.

(57) ABSTRACT

A power plant through which motive fluid flows including a vapor turbine into which motive fluid vapor is introduced and expanded so that power is produced, and a horizontal air-cooled condenser (ACC) for receiving and condensing the expanded motive fluid discharged from said vapor turbine. The condenser includes a plurality of mutually parallel and spaced condenser tubes across which air for condensing the motive fluid flows that are disposed at an angle of inclination with respect to a horizontal plane of at least 5 degrees, such that accumulated liquid condensate is evacuated by gravitational forces.

16 Claims, 2 Drawing Sheets

(51) Int. Cl.
*F28D 1/02* (2006.01)
*F28D 1/06* (2006.01)

(58) Field of Classification Search
CPC ..... F28D 2021/0063; F28D 2021/0068; F28D 2021/007; F28D 2021/0084; F28D 1/06; F01K 9/003; F01K 9/02; F01K 7/12; F01K 11/00; F01K 25/08; F28F 17/005; F28F 2265/06; F28F 2265/22
USPC ..... 60/670, 671; 165/DIG. 184, DIG. 182, 165/DIG. 212, 913
See application file for complete search history.

(56) References Cited

U.S. PATENT DOCUMENTS

| | | | | |
|---|---|---|---|---|
| 4,426,959 | A | 1/1984 | McCurley | |
| 4,537,248 | A | 8/1985 | Minami | |
| 4,815,296 | A | 3/1989 | Amir | |
| 2007/0095066 | A1* | 5/2007 | Kaplan | F01K 25/08 60/670 |
| 2008/0078198 | A1* | 4/2008 | Breiding | F28D 1/05383 62/324.5 |
| 2010/0012307 | A1* | 1/2010 | Taras | F28F 17/005 165/177 |
| 2012/0260655 | A1 | 10/2012 | Kaplan et al. | |
| 2017/0051980 | A1 | 2/2017 | Singh et al. | |

* cited by examiner

AIR-COOLED CONDENSER CONFIGURATION

FIELD

The present invention relates to the field of heat exchanger apparatus. More particularly, the invention relates to an air-cooled condenser configuration suitable for use in a power plant adapted for improved thermal performance.

BACKGROUND

Condensers are used in refrigeration plants to condense refrigeration vapors such as ammonia or fluorinated hydrocarbons, and in the petroleum and chemical industries such as for use in a fuel distillation apparatus to condense a variety of chemical vapors. They are also used in power plants to condense the motive fluid exhausted from turbines. See e.g. U.S. Pat. No. 9,689,630 the disclosure of which is incorporated by reference.

Air-cooled condensers (ACCs) are used in those geographical regions where cooling water for reducing the temperature of heat depleted vapor is scarce. In ACCs, heat is rejected from the hot fluid that flows through the tubes to the ambient air by induced or forced air flow, generally in cross flow by means of a fan, on the external side of the heat exchanger tubes. In addition to the plentiful nature of air serving as the condensing medium, a further advantage of an ACC is that air will not freeze as opposed to water at stagnation. The inherently low heat transfer coefficient is compensated for by high fin areas provided by the finned tubes of the ACC.

Several types of ACCs are known from the prior art. One type of an ACC is the horizontal condenser characterized by substantially horizontal and vertically spaced tubes through which fluid, such as motive fluid, to be condensed flows and which extend between an inlet header and an outlet header. The tubes are generally inclined at an inclination up to about 1 degree to assist in drainage and subsequent collection of the produced condensate at the outlet header. Condensate temperature can be reduced by increasing the total surface area of the heat exchanging tubes that is exposed to the surrounding flowing air.

Although a prior art horizontal ACC is economical by virtue of its relatively simple construction, it suffers from accumulation of liquid condensate within the interior of the tubes. As the cooling air flows across successive rows of tubes, the temperature of the air increases and the temperature differential between the air and the motive fluid consequently drops. Therefore, greater amounts of condensate will be produced within the rows of tubes that are first contacted by the relatively cool air flow, for example the lowermost rows when the cooling air flows upwards, than within the rows of tubes that are subsequently contacted by the air. As a result, the fluid, such as motive fluid, in the tubes of the rows within the rows of tubes that are first contacted by the relatively cool air flow may be close to being filled with condensate. Such conditions of close to flooding of the cross-section of the condenser tubes produced by the condensed fluid, such as motive fluid, within a central region of a condenser tubes not only represents a non-effective utilization of the tube surfaces, but also influences the turbine back pressure as the ACC is in fluid communication with the turbine when used in a power plant. If the back pressure is excessive, the power output may be reduced due to the low pressure differential between the turbine inlet and outlet and the corresponding low efficiency, or the rate at which available energy is converted to power.

Another type of an ACC is an A-shaped condenser, or V-shaped condenser when inverted. Although this type of condenser has a compact design resulting in considerable space savings, and has an increased heat transfer coefficient, it nevertheless has a smaller footprint than a horizontal condenser, and therefore has a considerably higher fan power requirement in order to provide the same volumetric air flow across the tubes. The increased fan-based power consumption often negates or even outweighs the savings realized by the increased heat transfer coefficient.

It is an object of the present invention to provide a horizontal air-cooled condenser that facilitates a decrease in the amount of liquid condensate accumulating within a condenser tube relative to the prior art and thereby an increase in power plant efficiency when used therein.

Other objects and advantages of the invention will become apparent as the description proceeds.

SUMMARY

The present invention provides a horizontal air-cooled condenser (ACC) suitable for a power plant, comprising an inlet header into which heated motive fluid vapor is introduced, an outlet header from which cooled motive fluid condensate is discharged, a plurality of mutually parallel and spaced condenser finned tubes extending between, and in fluid communication with, said inlet header and said outlet header, across which air for condensing the motive fluid flows, and a supporting structure for maintaining an upper surface of said inlet header in a vertically spaced relation above an upper surface of said outlet header and each of said condenser tubes at an angle of inclination with respect to a horizontal plane of at least 5 degrees, to cause any accumulated liquid condensate to become evacuated to said outlet header by gravitational forces.

The present invention is also advantageously directed to a power plant through which motive fluid flows, comprising a vapor turbine into which motive fluid vapor, vaporized in a vaporizer, is introduced and expanded so that power is produced, and a horizontal air-cooled condenser for receiving and condensing the expanded motive fluid vapor discharged from said vapor turbine, wherein said condenser comprises a plurality of mutually parallel and spaced finned condenser tubes across which air for condensing the motive fluid flows that are disposed at an angle of inclination with respect to a horizontal plane of at least 5 degrees, so that accumulated liquid condensate is evacuated by gravitational forces.

DETAILED DESCRIPTION

Geothermal fluid, i.e. geothermal steam and geothermal liquid or brine, particularly geothermal steam has been shown to be a convenient and quite readily available heat source for producing power in many areas of the world. The use of an Organic Rankine Cycle (ORC) is a well-accepted method for exploiting the energy content of geothermal fluid, whereby heat from the geothermal fluid is extracted and organic motive fluid flowing in a closed binary cycle is vaporized so that the organic vapor produced is expanded in an organic vapor turbine to produce power.

Figure 1:
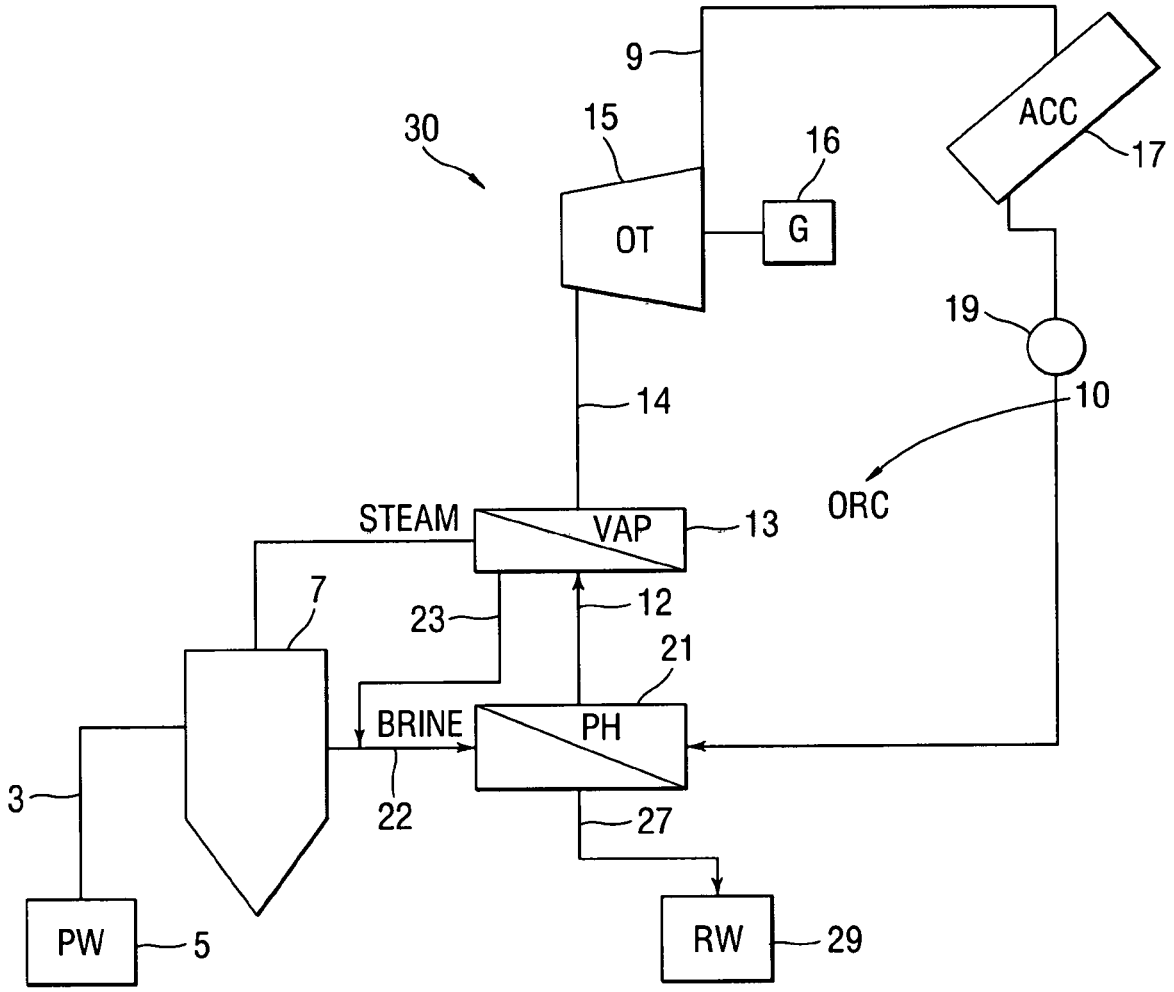
FIG. 1 is a schematic illustration of a geothermal based, binary cycle power plant, according to one suitable embodiment of the present invention.

An exemplary geothermal based, binary cycle power plant, designated by reference numeral 30, is schematically illustrated in FIG. 1 suitable for use in accordance to the teachings of the present invention. Other power plant configurations can of course can be considered to be within the scope of the invention.

The geothermal resource fluid is extracted from production well (PW) 5 and is supplied via line 3 to vaporizer 13, in order to vaporize the organic motive fluid of ORC power plant 10. The geothermal fluid maybe geothermal steam coming from a separator (as shown) or geothermal brine or liquid which can also be supplied from a separator or directly from production well 5. The vaporized organic fluid vapor produced is supplied via conduit 14 to organic vapor turbine (OT) 15, and expands therein to produce power and electricity by means of generator 16 coupled thereto. The expanded vapor discharge flows to inclined horizontal air-cooled condenser (ACC) 17 via conduit 9. The organic motive fluid condensate produced in ACC 17 is discharged therefrom and is pressurized by cycle pump (CP) 19, and is supplied to preheater (PH) 21 via conduit 8. The preheated organic motive fluid condensate produced flows through conduit 12 to vaporizer 13.

The separated geothermal liquid or brine exiting separator 7 (shown) is combined with steam condensate produced in vaporizer 13 via conduit 23, and the combined flow produced is supplied to PH 21 via conduit 22 in order to preheat the organic motive fluid condensate. The heat depleted brine produced exits preheater 21 via conduit 27 and is supplied to re-injection well (RW) 29.

Due to economical and environmental considerations, the organic motive fluid in many power plants is condensed by means of a horizontal ACC, whereby ambient air serves as the cooling medium for extracting heat from the organic motive fluid that is discharged from the organic vapor turbine. In order to ensure recirculation of the condensed organic fluid, a prior art horizontal ACC is inclined to an angle of up to about 1 degree to assist in gravity-driven drainage that is directed to the outlet header. However, it has been found that some motive fluid liquid condensate accumulates within the condenser tubes, and sometimes accumulated motive fluid liquid condensate can bring about even flooding of the condenser tubes, and the heat transfer coefficient is reduced. The accumulation of organic motive fluid condensate within the tubes of a horizontal ACC, which is in fluid communication with the turbine, causes an increase in the actual back pressure of the organic vapor turbine. Such an increase in the back pressure brings about a reduction in the power produced by the turbine, which is dependent upon the pressure ratio of the turbine inlet pressure and the turbine outlet pressure.

The condensation pressure, and therefore the turbine back pressure, is also influenced by the ambient air temperature, air velocity and not surface area of the condenser tubes. During hot periods, for example, the turbine back pressure will increase, resulting in loss of power produced and a considerable loss of revenue, particularly during a period when power demand and power prices are at a high level.

It has now been found that the amount of motive fluid condensate that accumulates within the tubes of horizontal ACC 17, and that the back pressure of turbine 15 at which motive fluid vapor is exhausted to the condenser from the vapor turbine are significantly decreased, by increasing the angle of inclination of the horizontal ACC, when used in the power plant, to an angle greater than approximately 5 degrees relative to a horizontal plane.

An increase in inclination of horizontal ACC 17 to an angle greater than approximately 5 degrees relative to a horizontal plane has heretofore not been practiced due to the added costs needed to support the inclined condenser. This is due to the long length of the condenser tubes needed to economically and efficiently utilize the tube surface exposed to the ambient cooling air and the consequent height difference of the supports provided at the two ends of the ACC required to furnish effective physical reinforcement.

When the length of the condenser tubes is e.g. about 18 m and the angle of inclination is 5 degrees, for example, a height differential of 0.94 m would exist between the two ends of the ACC, requiring increased cost for providing sufficient support for the ACC, whose standard height generally ranges from 5.5 to 12 m when used in the power plant. The height differential is greater if the angle of is increased.

Figure 2:
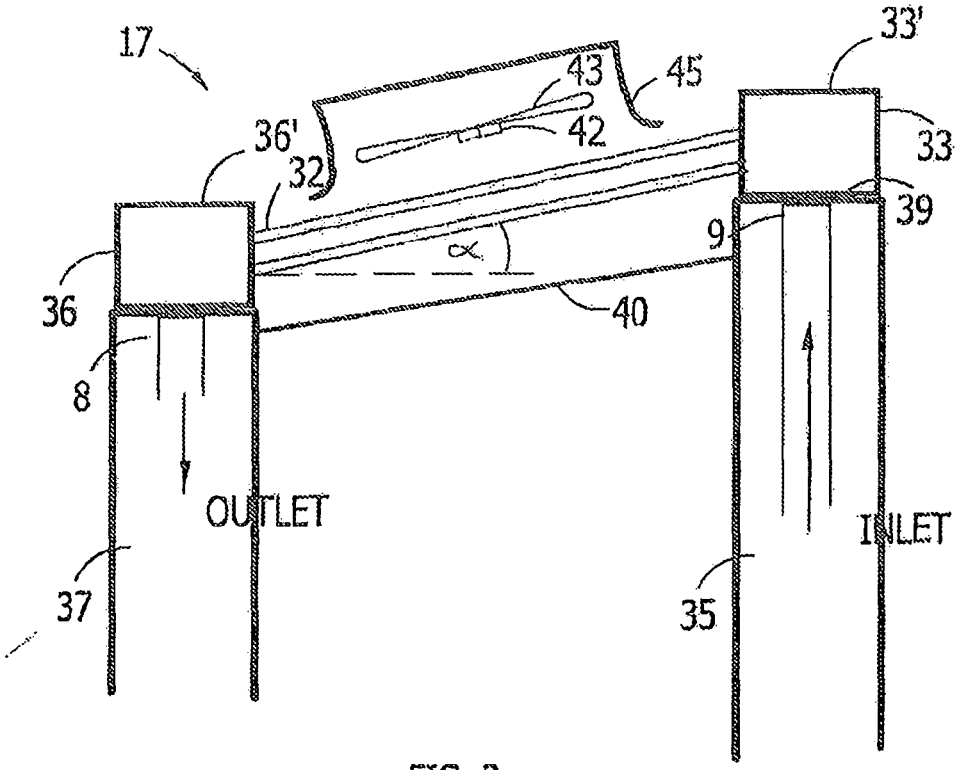
FIG. 2 is a schematic illustration of a horizontal air-cooled condenser suited for a power plant, some portions thereof removed for clarity, according to one embodiment of the present invention.

FIG. 2 illustrates a horizontal ACC suitable for use in a power plant such as a geothermal power plant, according to one embodiment of the present invention. Such horizontal ACC can be used in connection with apparatus described in U.S. patent application Ser. No. 15/269,140, the disclosure of which is hereby incorporated by reference. In particular, the embodiments described therein with reference to FIG. 7, FIG. 7A and FIG. 9 are referred to. Furthermore, such horizontal ACC can be used in connection with apparatus described in U.S. Pat. No. 8,601,814, the disclosure of which is also hereby incorporated by reference.

Horizontal ACC 17 suitable for use in the power plant comprises a plurality of mutually parallel, inclined condenser tubes 32, only two being shown, which are generally finned. Each tube 32 extends between inlet header 33 into which fluid vapor, such as turbine organic motive fluid vapor, discharges is introduced via conduit 9 and outlet header 36 from which cooled organic motive fluid condensate is discharged via conduit 8. Supporting structures 35 and 37, constructed from vertically oriented e.g. metallic elements, or any other type of element that stably supports inlet header 33 and outlet header 36 respectively as well as the ACC structure itself and provides them with sufficient structural strength without interfering with the condenser tubes 32. Such a structure provides support to each of inlet header 33 and outlet header 36 in such a manner that maintains upper surface 33' of inlet header 33 in a vertically spaced relation above upper surface 36' of outlet header 36 and each tube at an angle $\alpha$ with respect to a horizontal plane. An exemplary type of such a supporting structure 35 that may be employed can include a concrete pad on which supports 35 and 37 are positioned that is specially designed to take into account angle $\alpha$. If so desired, supporting structures 35 and 37 may be annular. Advantageously, supports 35 and 37 can provide support to support frame 40 provided below and in the vicinity of condenser tubes 32 and inlet header 33 and outlet header 36 so that support is amply provided for all of the ACC structure.

Thus, here, when the organic motive fluid vapor is discharged from the turbine via conduit 9 to inlet header 33, the expanded vapors and motive condensate produced gravitates within each condenser tube 32 towards outlet header 36, from which it is delivered as liquid condensate to the cycle pump. The turbine discharge may be introduced into inlet header 33 via a lower port 39, or alternatively through an upper port. In such a manner, substantially all of the liquid head losses are overcome so that a marked increase in overall heat transfer coefficient is achieved so that the condensing pressure is reduced.

The cooling air to satisfactorily cool and condense the organic motive fluid is generated by fan assembly 43, which comprises a hub, constant-pitch blades that are attached to the hub, and a shaft connected to the hub and coupled to a motor shaft. The motor is connected to and supported by a support 42, which may be connected to supporting structure 35. Accordingly, the fan shaft may be perpendicular to the longitudinal axis of each tube 32, or may be disposed at any other desired angle, to provide an optimal flow pattern and velocity to maximize cooling. Shroud 45 is also provided to direct the cooling air exiting the ACC. Fan assembly 43 may be disposed above the tube bundles as shown to draw the air flow across tubes 32, or alternatively, if desired, may be disposed below the tube bundles to drive the air flow across tubes 32.

A suitable angle $\alpha$ of condenser tubes 32 with respect to a horizontal plane was found to be between about 3-20 degrees, and preferably 6 degrees. in this range, the static head of the condensate, which is dependent upon the height differential between the upper and lower ends of tubes 32, is sufficiently large to cause the accumulated liquid condensate to become evacuated by gravitational forces and to overcome the surface tension experienced by the organic motive fluid within the tubes. The upper limit of 20 degrees takes into account safety considerations in compliance with the US Occupational Safety and Health Administration (OSHA) regulations. Typical types of organic motive fluid that are suitable for the invention include n-pentane, iso-pentane, cyclo-pentane, n-butane and iso-butane, etc. which do not freeze at ambient temperatures ranging from −60° C. to 55° C.

Unexpectedly, at an angle of inclination of about 6 degrees, when used in a power plant, the power output of ORC power plant 30 (FIG. 1) substantially increased due to reduced back pressure at the exit of organic vapor turbine 15, achieving an increase of 5-10% in heat transfer efficiency relative to the prior art heat transfer efficiency where the horizontal ACC was disposed at an angle of inclination of about 1 degree or less with respect to a horizontal plane. The heat transfer area of the horizontal ACCs in ORC power plant 30 can consequently be able to be reduced by reducing the number of condensers tubes that were needed to generate the same level of power, thereby significantly reducing capital and operating costs.

For example, under conditions at the test facility at McGinnes Hills located in Nevada, USA, the back pressure was found to be about 20 psia when the horizontal ACCs were inclined at 6 degrees relative to horizontal, a lower pressure level of 1.1.3 psi compared to the back pressure when prior art horizontal ACCs inclined at about 1 degree or less were in use. Ambient temperatures ranged from about 14-17.5° C.

Thus, the present invention can be considered, when used in a power plant, to constitute a method for increasing the power output of a power plant wherein the power plant can be a power plant using an organic motive fluid such as an Organic Rankine Cycle (ORC) power plant.

Furthermore, while it is mentioned that the power plant of the present invention can be a geothermal power plant, the power plant of the present invention can be a waste heat power plant or energy recovery power plant or any other power plant utilizing a heat source suitable for ORC power plant operation.

In addition, the heat exchanger or horizontal air-cooled condenser (ACC) of the present invention can be used to retrofit an existing power plant as well in a new power plant.

While the present invention described herein is described with relation to a power plant and its use therein, the heat exchanger or horizontal air-cooled condenser (ACC) of the present invention can be used in other apparatus e.g., in refrigeration plants to condense refrigeration vapors such as ammonia or fluorinated hydrocarbons, and in the petroleum and chemical industries such as for use in a fuel distillation apparatus to condense a variety of chemical vapors.

In addition, we would like to point out that, in accordance with the present invention, the inclined ACC can utilize a single pass, fin tube arrangement or an arrangement utilizing more than a single pass for the fin tubes, e.g. a 2 pass, 3 pass, etc. arrangement having a horizontal or vertical pass arrangement.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A horizontal air-cooled condenser (ACC) suitable for a power plant, comprising:

a) an inlet header into which heated motive fluid of the power plant having a temperature greater than ambient air is introduced;

b) an outlet header from which cooled motive fluid condensate is discharged;

c) a plurality of mutually parallel and spaced tubular condenser tubes extending between, and in fluid communication with, said inlet header and said outlet header, across which the ambient air for condensing the motive fluid flows;

d) a supporting structure for maintaining an upper surface of said inlet header in a vertically spaced relation above an upper surface of said outlet header and each of said condenser tubes at an angle of inclination with respect to a horizontal plane of at least 5 degrees, to cause any liquid motive fluid condensate that has accumulated in one or more of said plurality of condenser tubes to become evacuated via said outlet header by gravitational forces; and e) a fan assembly mounted on a support for forcing the flow of air across said plurality of condenser tubes to condense the motive fluid flowing therethrough, wherein a shaft of the fan assembly is perpendicular to a longitudinal axis of each of said condenser tubes.

2. The horizontal ACC according to claim 1, wherein the supporting structure is configured to maintain each of the condenser tubes at an angle of inclination with respect to a horizontal plane ranging from 5 to 20 degrees.

3. The horizontal ACC according to claim 2, wherein the supporting structure is configured to maintain each of the condenser tubes at an angle of inclination with respect to a horizontal plane of 10 to 20 degrees.

4. The horizontal ACC according to claim 1, wherein the fan assembly support is connected to the supporting structure.

5. The horizontal ACC according to claim 1, wherein the power plant comprises an Organic Rankine Cycle (ORC) power plant.

6. The horizontal ACC according to claim 1, wherein said power plant further comprises a vapor turbine and said heated motive fluid comprises motive fluid vapor exiting said vapor turbine.

7. The horizontal ACC according to claim 1, wherein the motive fluid comprises an organic motive fluid, and the angle of inclination of the condenser tubes is selected to provide the liquid organic condensate produced by the ACC with a sufficiently large static head able to become gravitationally evacuated from the ACC and to overcome surface tension experienced by the liquid organic condensate within the tubes.

8. The horizontal ACC according to claim 6, wherein, the vapor turbine is an organic vapor turbine.

9. The horizontal ACC according to claim 1, wherein the plurality of mutually parallel and spaced condenser tubes are tubular.

10. An Organic Rankine Cycle (ORC) power plant through which motive fluid flows, comprising an organic vapor turbine into which organic motive fluid vapor is introduced and expanded so that power is produced, and a horizontal air-cooled condenser (ACC) for receiving and condensing the expanded organic motive fluid discharged directly or indirectly from said organic vapor turbine, wherein said condenser comprises a plurality of mutually parallel and spaced condenser tubes across which air for condensing the organic motive fluid flows that are disposed at an angle of inclination with respect to a horizontal plane of at least 5 degrees, to provide liquid organic motive fluid condensate that has accumulated in one or more of said plurality of condenser tubes with a sufficiently large static head able to become gravitationally evacuated from the ACC and to overcome surface tension experienced by the liquid organic motive fluid condensate within the tubes, wherein said power plant has a significantly greater power output when said plurality of condenser tubes are disposed at a specific angle of inclination with respect to a horizontal plane greater than 5 degrees than when said plurality of condenser tubes are disposed at a significantly smaller angle of inclination with respect to a horizontal plane, by virtue of corresponding reduced back pressure at an exit of the organic vapor turbine when said plurality of condenser tubes are disposed at the specific angle of inclination relative to the significantly smaller angle of inclination.

11. The power plant according to claim 10, wherein said horizontal ACC further comprises a supporting structure configured to maintain each of the condenser tubes at an angle of inclination with respect to a horizontal plane ranging from 5 to 20 degrees.

12. The power plant according to claim 10, which is a binary cycle power plant which comprises a vaporizer for vaporizing the organic motive fluid with a fluid supplied from a heat source.

13. The power plant according to claim 10, further comprising a recuperator that heats the organic motive fluid by the expanded organic motive fluid discharged from the organic vapor turbine and that supplies the ACC with heat depleted organic motive fluid exiting the recuperator.

14. The power plant according to claim 10, further comprising a fan assembly mounted on a support for forcing the flow of air across the plurality of condenser tubes to condense the motive fluid flowing therethrough.

15. The power plant according to claim 14, wherein a shaft of the fan assembly is perpendicular to a longitudinal axis of each of the condenser tubes.

16. The power plant according to claim 14, wherein a shaft of the fan assembly is disposed at a non-perpendicular angle with respect to a longitudinal axis of each of the condenser tubes that optimizes a flow pattern and velocity of the ambient air for purposes of cooling the motive fluid.

* * * * *